US011479433B2

(12) United States Patent
Tamura

(10) Patent No.: US 11,479,433 B2
(45) Date of Patent: Oct. 25, 2022

(54) SHEET CONVEYING DEVICE AND IMAGE FORMING APPARATUS INCORPORATING THE SHEET CONVEYING DEVICE

(71) Applicant: Tomonori Tamura, Kanagawa (JP)

(72) Inventor: Tomonori Tamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 206 days.

(21) Appl. No.: 16/557,251

(22) Filed: Aug. 30, 2019

(65) Prior Publication Data

US 2020/0130978 A1 Apr. 30, 2020

(30) Foreign Application Priority Data

Oct. 30, 2018 (JP) ..... JP2018-204141

(51) Int. Cl.

| | |
|---|---|
| ***B65H 29/04*** | (2006.01) |
| ***B65H 29/54*** | (2006.01) |
| ***B65H 29/14*** | (2006.01) |
| ***B65H 29/12*** | (2006.01) |

(52) U.S. Cl.

CPC ..... *B65H 29/54* (2013.01); *B65H 29/125* (2013.01); *B65H 29/14* (2013.01)

(58) Field of Classification Search

CPC ..... B65H 29/54; B65H 29/125; B65H 29/14; B65H 29/003; B65H 29/005; B65H 29/04; B65H 29/041; B65H 29/045; B65H 29/047; B65H 29/048; B65H 29/06; B65H 29/10; B65H 29/28; B65H 2301/4354; B65H 2301/44712

See application file for complete search history.

(56) References Cited

U.S. PATENT DOCUMENTS 2,753,798 A * 7/1956 Babst ..... B65H 29/041 101/232
4,647,032 A * 3/1987 Oba ..... B65H 29/048 271/186

(Continued)

FOREIGN PATENT DOCUMENTS

JP 2001-163497 6/2001
JP 2005-089009 4/2005

(Continued)

OTHER PUBLICATIONS

Japanese communication with the dispatch No. 165295 issued by the Japan Patent Office dated Apr. 12, 2022 for Japanese Patent Application No. 2018-204141.

*Primary Examiner* — Thomas A Morrison
(74) *Attorney, Agent, or Firm* — Harness, Dickey & Pierce, P.L.C.

(57) ABSTRACT

A sheet conveying device includes a tray, a conveyor, and a guide body. The tray is configured to stack a sheet. The conveyor is configured to convey the sheet to the tray. The guide body has a space, a height of the space being greater than a thickness of the sheet. The guide body is configured to guide the sheet conveyed by the conveyor, with a leading end of the sheet being inserted in the space. The guide body is configured to separate the sheet from the space, according to a difference of a sheet conveying speed of the conveyor and a moving speed of the guide body, and to stack the sheet on the tray.

14 Claims, 6 Drawing Sheets

(56) References Cited

U.S. PATENT DOCUMENTS 4,830,355 A * 5/1989 Jeschke ..... B65H 29/683 271/183
5,123,807 A * 6/1992 Nakaoda ..... B65H 43/00 271/189
5,226,641 A * 7/1993 Schieleit ..... B65H 29/40 271/187
6,394,448 B2 * 5/2002 Suzuki ..... B65H 29/02 271/189
6,527,501 B2 * 3/2003 Wolf ..... B65H 31/20 271/224
7,487,968 B2 * 2/2009 Landwehr ..... B65H 39/10 271/312
7,954,816 B2 * 6/2011 Freitag ..... B65H 83/02 271/277
8,220,618 B2 * 7/2012 Bijl ..... B65G 17/326 198/803.1
8,939,447 B2 * 1/2015 Remijnse ..... B65H 29/041 271/199
9,010,753 B2 * 4/2015 Shibasaki ..... B65H 31/36 271/274
9,840,389 B2 * 12/2017 Lewalski ..... B65H 35/04
2008/0061498 A1 * 3/2008 Suzuki ..... B65H 29/54 271/264
2009/0250862 A1 * 10/2009 Oosterhoff ..... B65H 29/041 271/3.18
2010/0270125 A1 * 10/2010 Bijl ..... B65H 29/041 198/470.1
2014/0203500 A1 * 7/2014 Yanagida ..... B65H 29/22 271/193

FOREIGN PATENT DOCUMENTS

JP 2008-63094 A 3/2008
JP 2010-168218 8/2010
JP 2014-162601 9/2014

* cited by examiner

SHEET CONVEYING DEVICE AND IMAGE FORMING APPARATUS INCORPORATING THE SHEET CONVEYING DEVICE

CROSS-REFERENCE TO RELATED APPLICATION

This patent application is based on and claims priority pursuant to 35 U.S.C. § 119(a) to Japanese Patent Application No. 2018-204141, filed on Oct. 30, 2018, in the Japan Patent Office, the entire disclosure of which is hereby incorporated by reference herein.

BACKGROUND

Technical Field

This disclosure relates to a sheet conveying device and an image forming apparatus incorporating the sheet conveying device.

Related Art

Various types of sheet conveying devices convey sheets using a roller, a conveying belt, or both. Such sheet conveying devices are known to employ a technique that, in a case in which there is an area where any roller or conveying belt cannot be disposed due to functional reasons of a sheet conveying device, a roller or a belt disposed immediately before the area pushes a sheet to convey the sheet toward a further device or unit. In such a sheet conveying device, when a low-rigidity sheet such as a thin paper, or a large-size sheet is pushed to be conveyed, the leading end of the sheet is lifted or curled, which is likely to result in a paper jam.

In order to prevent such a problem, some techniques to convey a sheet while a nipping member such as a gripper is nipping the leading end of a sheet have been proposed. However, when performing these techniques, the nipping member is moved to open when a sheet is loaded onto a tray. In other words, since an opening and closing mechanism to open and close the nipping member is provided in the sheet conveying device, the cost of the sheet conveying device is likely to increase.

SUMMARY

At least one aspect of this disclosure provides a sheet conveying device including a tray, a conveyor, and a guide body. The tray is configured to stack a sheet. The conveyor is configured to convey the sheet to the tray. The guide body has a space. A height of the space is greater than a thickness of the sheet. The guide body is configured to guide the sheet conveyed by the conveyor, with a leading end of the sheet being inserted in the space. The guide body is configured to separate the sheet from the space, according to a difference of a sheet conveying speed of the conveyor and a moving speed of the guide body, and to stack the sheet on the tray.

Further, at least one aspect of this disclosure provides an image forming apparatus including an image forming device configured to form an image on a sheet, and the above-described sheet conveying device configured to convey the sheet on which the image is formed.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
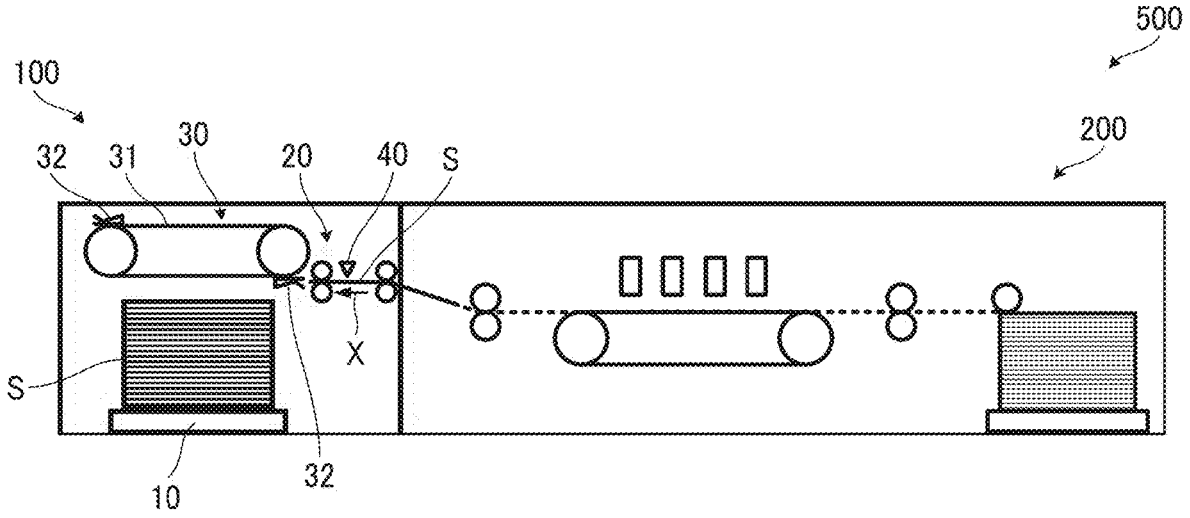
FIG. 1 is a schematic diagram illustrating an example of an image forming apparatus including a sheet conveying device according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet conveying device and an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any heating device, and is implemented in the most effective manner in any inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a sheet conveying device and an image forming apparatus incorporating the sheet conveying device, with reference to the following figures.

It is to be noted that elements (for example, mechanical parts and components) having the same functions and shapes are denoted by the same reference numerals throughout the specification and redundant descriptions are omitted.

A description is given of an image forming apparatus according to this disclosure, with reference to FIG. 1.

FIG. 1 is a schematic diagram illustrating an example of an image forming apparatus 500 including a sheet conveying device 100 according to an embodiment of this disclosure.

Further, size (dimension), material, shape, and relative positions used to describe each of the components and units are examples, and the scope of this disclosure is not limited thereto unless otherwise specified.

As illustrated in FIG. 1, an image forming apparatus 500 includes a printing device 200 and a sheet conveying device 100. The printing device 200 functions as an image forming device to form an image on a sheet S that functions as a recording medium such as a paper. The sheet conveying device 100 conveys the sheet S with the image by the printing device 200 and stacks the sheet S on a tray.

The image forming apparatus 500 is an inkjet recording apparatus that includes inkjet heads that discharge different inks of four colors of black (B), cyan (C), magenta (M), and yellow (Y).

The sheet conveying device 100 includes a tray 10 and a sheet conveying unit 20. The tray 10 loads the sheet S. The sheet conveying unit 20 that functions as a conveyor to convey the sheet S from the printing device 200 towards the tray 10.

The sheet conveying device 100 further includes a sheet holder 30. After receiving and nipping the sheet S that has been conveyed by the sheet conveying unit 20, the sheet holder 30 conveys the sheet S along a sheet conveying direction X in which the sheet conveying unit 20 conveys the sheet S, at a speed faster than a sheet conveying speed of the sheet conveying unit 20, to guide the sheet S onto the tray 10.

The sheet conveying device 100 further includes a detector 40 that is disposed in the sheet conveying unit 20 to detect the leading end of the sheet S.

In the sheet conveying device 100, the sheet S that has been held by the sheet holder 30 is separated from the sheet holder 30 according to a difference of the sheet conveying speed of the sheet conveying unit 20 and the sheet conveying speed of the sheet holder 30, so that the sheet S separated from the sheet holder 30 is staked onto the tray 10.

The sheet holder 30 includes a sheet conveying belt 31 and clips 32. The sheet conveying belt 31 is rotatably disposed in the sheet holder 30. Each of the clips 32 functions as a nipping body that is mounted on the sheet conveying belt 31.

The sheet holder 30 is disposed on a downstream side in the sheet conveying direction X of the sheet conveying unit 20. The sheet holder 30 holds and conveys the sheet S along the sheet conveying direction X, that is, in a direction to be parallel to the sheet conveying direction X of the sheet conveying unit 20.

Figure 2:
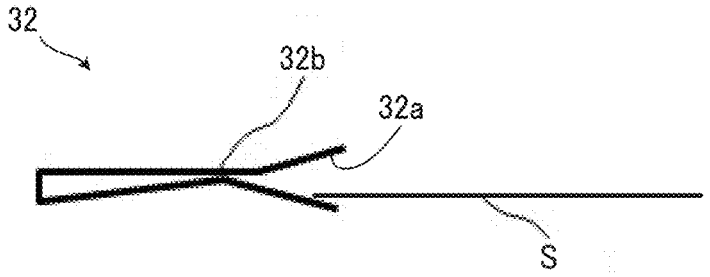
FIG. 2 is a diagram illustrating an example of a nipping member provided in the sheet conveying device according to an embodiment of this disclosure.

FIG. 2 is a diagram illustrating a nipping body (i.e., the clips 32) provided in the sheet conveying device 100 according to an embodiment of this disclosure.

As illustrated in FIG. 2, each of the clips 32 has an opening 32*a* and a nipping portion 32*b*. The opening 32*a* receives the sheet S. In other words, the sheet S is inserted into the opening 32*a*. The nipping portion 32*b* nips (grips) the sheet S that is inserted from the opening 32*a*.

Force with which the nipping portion 32*b* nips the sheet S is set to be slightly smaller than frictional force generated between the sheet conveying unit 20 and the sheet S. Consequently, the nipping portion 32*b* allows entrance of the sheet S due to the rigidity of the sheet S that is inserted from the opening 32*a* according to the difference of the sheet conveying speed of the sheet conveying unit 20 and the sheet conveying speed of the sheet holder 30, and nips the sheet S with the elasticity of the nipping portion 32*b*.

In the present embodiment, the opening 32*a* has a respectively wide opening area, and therefore the sheet S is inserted into either of the clips 32 easily. Since a sheet conveying passage from the opening 32*a* to the nipping portion 32*b* is flat and smooth without any projection or recess, an amount of load generated when the sheet S enters the nipping portion 32*b* is reduced. Each of the clips 32 contacts front and back faces of the sheet S to nip the sheet S from both sides. According to this configuration, the sheet S is reliably nipped without being affected by tolerances when compared with a case in which the clip 32 nips one side of the sheet S and a different member such as the sheet conveying belt 31 holds a different side of the sheet S.

Consequently, the sheet S is reliably stacked onto the tray 10. Further, the sheet S is prevented from receiving stains from the different member such as the sheet conveying belt 31 or from a positional displacement caused by being hit or collided and conveyed by the different member such as the sheet conveying belt 31. A contact face of the clip 32 that contacts the sheet S is preferably formed by a material having high smoothness such as metal and resin. Accordingly, the sheet S is smoothly inserted into each of the clips 32.

The clips 32 stand by at respective home positions, which are different positions spaced apart from each other in the sheet conveying direction, until the detector 40 detects the leading end of the sheet S. Then, after having completed conveyance of the sheet S, the clips 32 return to the respective home positions along with rotation of the sheet conveying belt 31 and stop.

In the present embodiment, as illustrated in FIG. 1, a plurality of clips 32, specifically, two clips 32 are arranged to be different in phase by 180 degrees to each other, along the rotational direction of the sheet conveying belt 31. Consequently, the time for the clips 32 to return to the respective home positions is reduced, and therefore the loss of time is restrained.

Three or more clips 32 may be arranged along the rotational direction of the sheet conveying belt 31. When arranging the plurality of clips 32 on the sheet conveying belt 31, it is preferable to arrange the phase to be equally divided.

Figure 3:
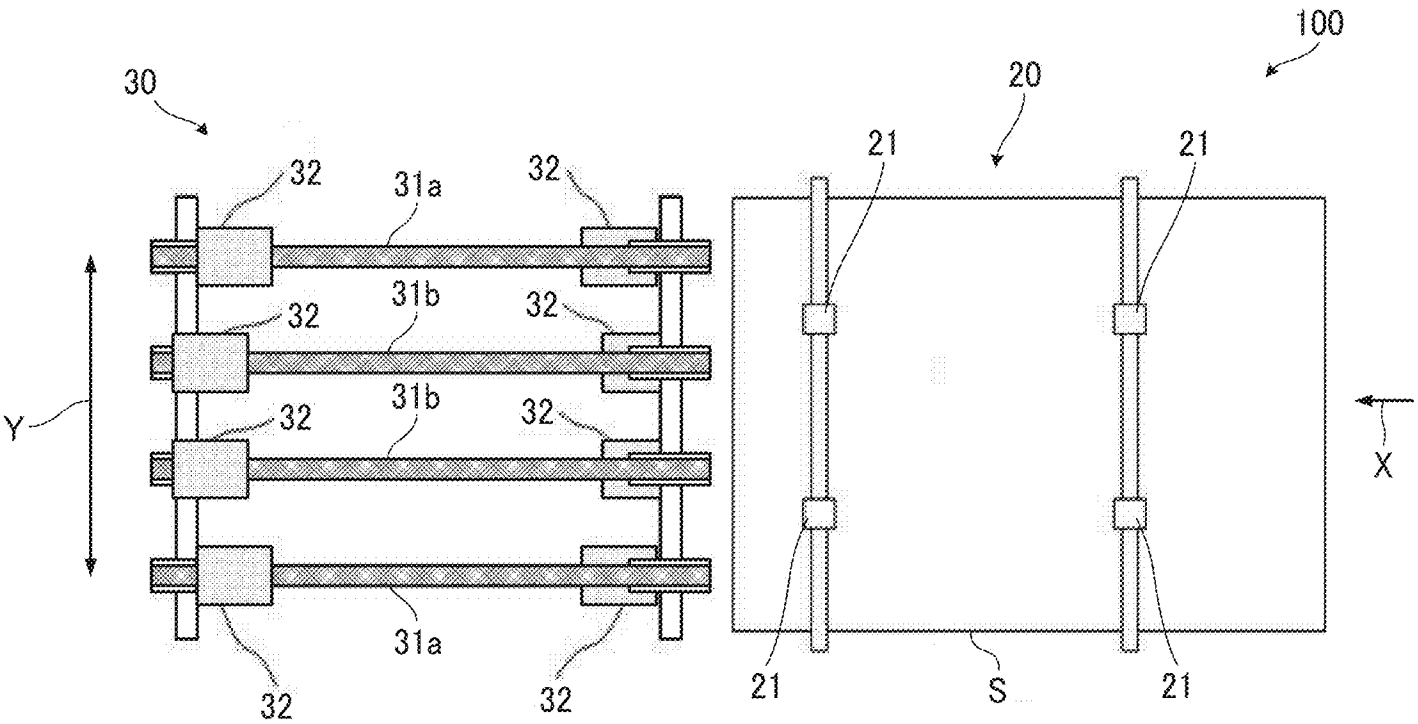
FIG. 3 is a plan view illustrating an example of the sheet conveying device according to an embodiment of this disclosure.

FIG. 3 is a plan view illustrating an example of the sheet conveying device 100 according to the present embodiment of this disclosure.

As illustrated in FIG. 3, a plurality of sheet conveying belts 31, specifically, four sheet conveying belts 31 are disposed in a width direction Y of the clips 32, which intersects the sheet conveying direction X. The clips 32 are mounted on each of the plurality of sheet conveying belts 31. Consequently, each of the clips 32 is reduced in size, and therefore the inertial load is reduced. Further, by nipping the sheet S with the plurality of clips 32, the attitude of the sheet S becomes reliably stable.

The plurality of sheet conveying belts 31 is classified to two types, which are end side belts 31*a* and center side belts 31*b*. Each end side belt 31*a* is disposed on an end side in the direction Y, which is the width direction of the clips 32. Each center side belt 31*b* is disposed between the end side belts 31*a* in the direction Y.

The clips 32 on the end side belt 31*a* are different in arrangement in the sheet conveying direction X from the clips 32 on the center side belt 31*b*. That is, the clips 32 mounted on the center side belt 31*b* are disposed upstream from the clips 32 mounted on the end side belt 31*a* in a sheet conveying direction of the sheet holder 30 in which the sheet holder 30 conveys the sheet S.

According to this arrangement, a timing at which the sheet S is inserted into the clips 32 is shifted between the end side belt 31*a* and the center side belt 31*b*, and therefore a load applied when the sheet S enters the clips 32 is reduced. Since a timing at which the sheet is separated from the clip 32 is also shifted, the sheet S retains the stable attitude.

In the present embodiment, four sheet conveying belts 31 are provided in the direction Y. However, the number of the sheet conveying belts 31 is not limited to four. For example, three sheet conveying belts 31 may be provided in the direction Y or five or more sheet conveying belts 31 may be provided. In a case in which five or more sheet conveying belts 31 are provided, two or more end side belts 31*a* may be disposed on each side in the direction Y.

In a case in which no center side belt 31*b* is provided, the number of the sheet conveying belts 31 may be two.

As illustrated in FIG. 3, the sheet conveying unit 20 includes a roller 21.

As long as the sheet conveying speed is controlled easily, the sheet conveying unit 20 may convey the sheet S with the sheet conveying belt 31 or may convey the sheet S with combination of the roller 21 and the sheet conveying belt 31.

Figure 4:
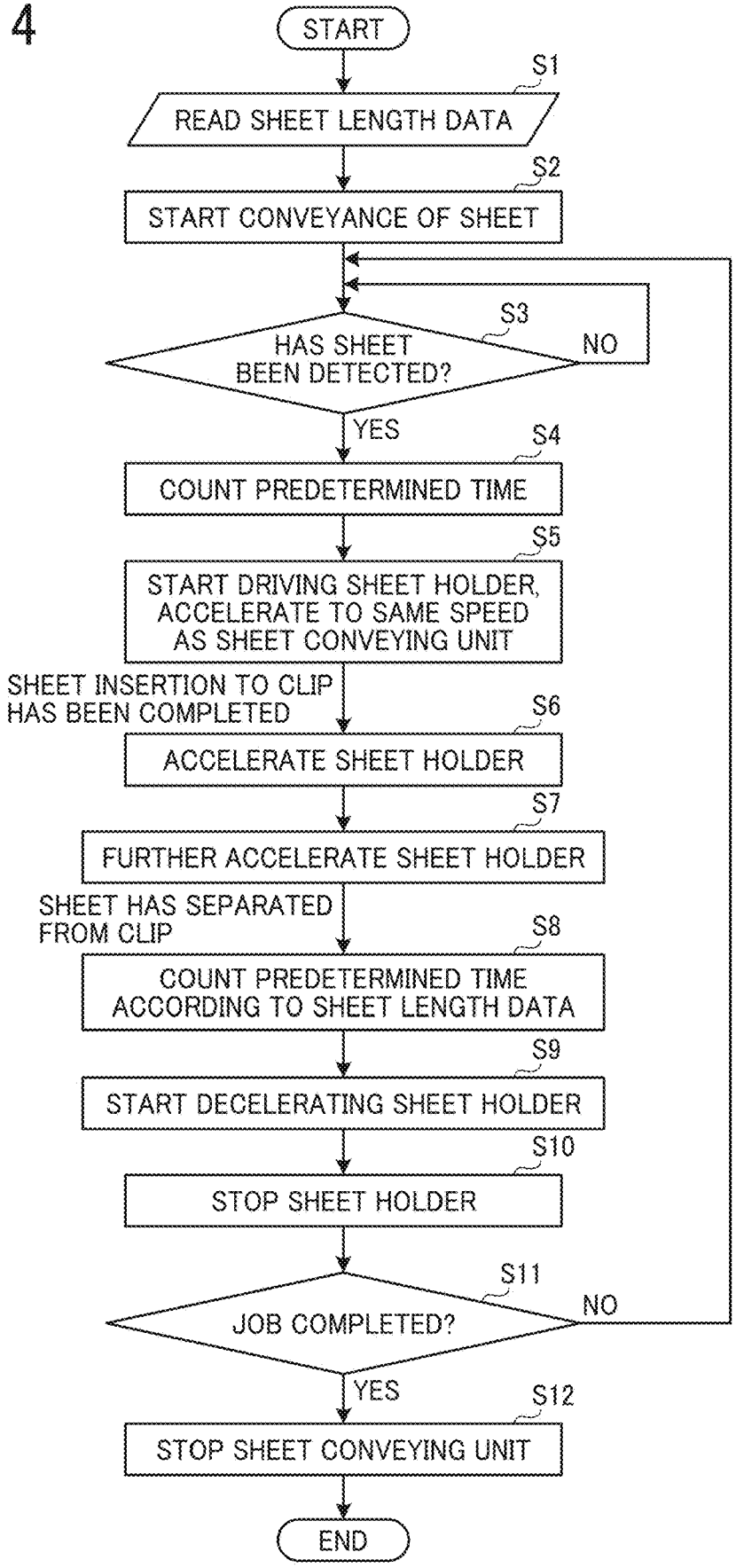
FIG. 4 is a flowchart of an example of a sheet conveying method according to an embodiment of this disclosure.
Figure 5:
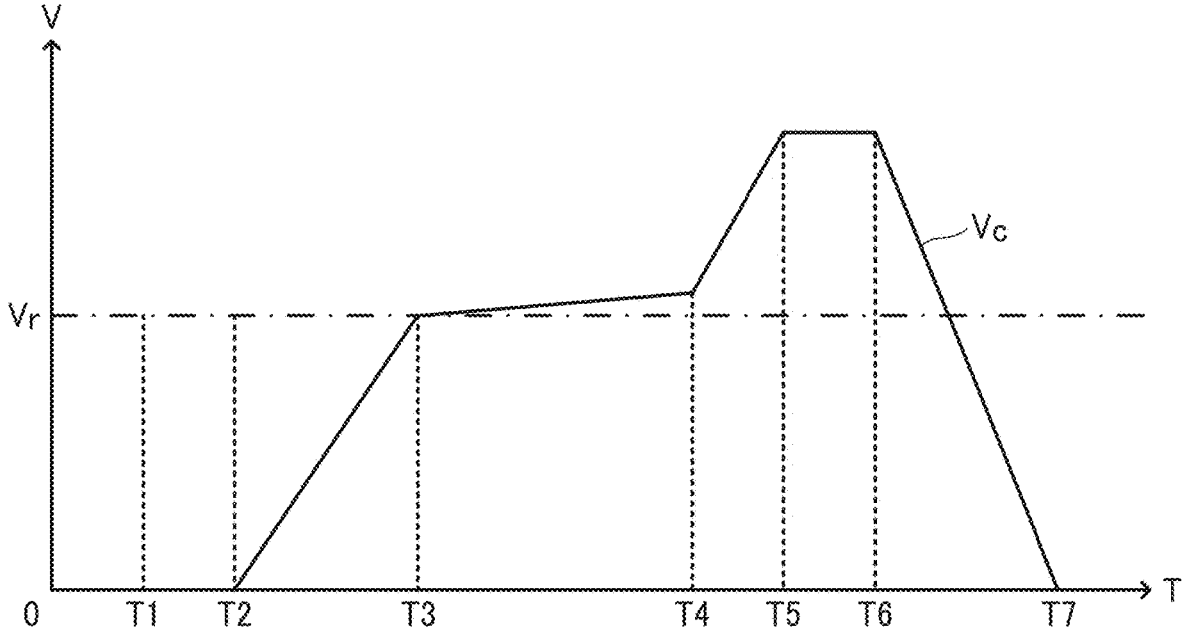
FIG. 5 is a graph of an example of a change in a sheet conveying speed of a sheet conveying unit and a sheet conveying speed of a sheet holder, both provided in the sheet conveying device of FIG. 3.

FIG. 4 is a flowchart of an example of a sheet conveying method performed by the sheet conveying device 100 according to an embodiment of this disclosure. FIG. 5 is a graph of an example of a change in the sheet conveying speed of the sheet holder 30 based on the sheet conveying speed of the sheet conveying unit 20. In FIG. 5, the vertical axis in the graph represents sheet conveying speed V and the horizontal axis in the graph represents time T. A change in a sheet conveying speed Vr of the sheet conveying unit 20 is indicated with a broken line and a change in a sheet conveying speed Vc of the sheet holder 30 is indicated with a solid line.

As indicated in the flowchart of FIG. 4, in step S1, the sheet conveying device 100 previously obtains (reads) sheet length data of a sheet S to be used, from the printing device 200.

In step S2, the sheet conveying unit 20 starts driving along with the start of driving of the printing device 200, so that the sheet conveying unit 20 starts conveyance of the sheet S that has entered from the printing device 200.

In step S3, it is determined whether the detector 40 has detected the leading end of the sheet S. When the detector 40 has not detected the leading end of the sheet S (NO in step S3), the operation of step S3 is repeated until the detector 40 detects the leading end of the sheet S.

When the detector 40 has detected the leading end of the sheet S (YES in step S3), in step S4, a predetermined time that functions as an elapsed time starting from a detection timing of the leading end of the sheet S (indicated as T1 in the graph of FIG. 5, in other words, a timing T1) is counted.

When the predetermined time has elapsed (indicated as T2 in the graph of FIG. 5, in other words, a timing T2), in step S5, the sheet holder 30 starts driving, and the clips 32 that have been stopped at the respective home positions start increasing the speed (start accelerating). At this time, since the speed of the sheet S that has been conveyed by the sheet conveying unit 20 is faster than the speed of the clips 32, the sheet S enters one of the clips 32. The speed of the sheet holder 30 is controlled such that the speed of conveyance of the sheet S is equal to the speed of movement of the clips 32 when the sheet S is completely inserted into one of the clips 32 (indicated as T3 in the graph of FIG. 5, in other words, a timing T3).

Thus, the sheet S is inserted into the clip 32 according to a difference in speed of the sheet conveying unit 20 and the clips 32 before the speed of movement the clips 32 becomes equal to the sheet conveying speed of the sheet conveying unit 20.

When the sheet holder 30 holds (nips) the sheet S (i.e., the timing T3 in the graph of FIG. 5), in step S6, first acceleration of the sheet conveying speed of the sheet holder 30 is performed, that is, the sheet conveying speed of the sheet holder 30 is accelerated when nipping the sheet S. Then, a predetermined time according to the sheet length data that has been previously obtained by the sheet conveying device 100 is counted. The sheet S is conveyed by the sheet conveying unit 20 and the sheet holder 30 according to the difference of the sheet conveying speed of the sheet conveying unit 20 and the sheet conveying speed of the sheet holder 30, generated by the first acceleration. Specifically, the sheet conveying speed of the sheet holder 30 becomes faster than the sheet conveying speed of the sheet conveying unit 20, and therefore the leading end of the sheet S is pulled while the sheet S is being conveyed. Accordingly, sag of the sheet S is more prevented when compared with a case in which the sheet conveying speed of the sheet holder 30 is equal to the sheet conveying speed of the sheet conveying unit 20.

At this time, force of the clip 32 to hold (nip) the sheet S is slightly smaller than frictional force between the sheet conveying unit 20 and the sheet S. Therefore, while gradually coming off from the clip 32, the clip 32 remains holding (nipping) the sheet S from a position at which the sheet S is nipped to a position at which the sheet S is separated.

When the predetermined time has elapsed since the sheet holder 30 nips the sheet S (indicated as T4 in the graph of FIG. 5, in other words, a timing T4), in step S7, second acceleration of the sheet conveying speed of the sheet holder 30 is performed, that is, the sheet conveying speed of the sheet holder 30 is accelerated when releasing the sheet S. Due to the second acceleration, the sheet conveying speed of the sheet holder 30 is further faster than the sheet conveying speed of the sheet conveying unit 20, and the sheet S is separated from the clip 32 (at a timing indicated as T5 in the graph of FIG. 5, in other words, a timing T5). It is to be noted that, even if the sheet S comes out from the sheet conveying unit 20 before the sheet S is separated from the clip 32, the sheet S is separated due to an inertial force of the sheet S.

Thus, the sheet S that is held by the sheet holder 30 is separated from the sheet holder 30 according to the difference of the sheet conveying speed of the sheet conveying unit 20 and the sheet conveying speed of the sheet holder 30, generated by the second acceleration. After having been separated from the sheet holder 30 and having come out from the sheet conveying unit 20, the sheet S falls onto the tray 10 to be stacked on the tray 10.

In step S8, a predetermined time according to the sheet length data previously obtained by the sheet conveying device 100 is counted.

When the predetermined time has elapsed since the sheet S has been separated from the sheet holder 30 (indicated as T6 in the graph of FIG. 5, in other words, a timing T6), the sheet holder 30 starts to gradually decelerate in step S9 and stops in step S10 (indicated as T7 in the graph of FIG. 5, in other words, a timing T7).

In step S11, it is determined whether a print job in the printing device 200 is completed.

When it is determined in step S11 that the print job is not completed (NO in step S11), the process returns to step S3 to determine whether the detector 40 has detected the leading end of a subsequent sheet S. The operations of steps S3 to S10 are repeated until the print job is completed.

When it is determined in step S11 that the print job is completed (YES in step S11), the sheet conveying unit 20 stops in step S12.

Thus, the sheet S is inserted into the clip 32 and is separated from the clip 32, according to the difference of the sheet conveying speed of the sheet conveying unit 20 and the sheet conveying speed of the sheet holder 30. Accordingly, the sheet S is stacked on the tray 10 without providing (installing) an opening and closing mechanism to open and close the clip 32.

Figure 6:
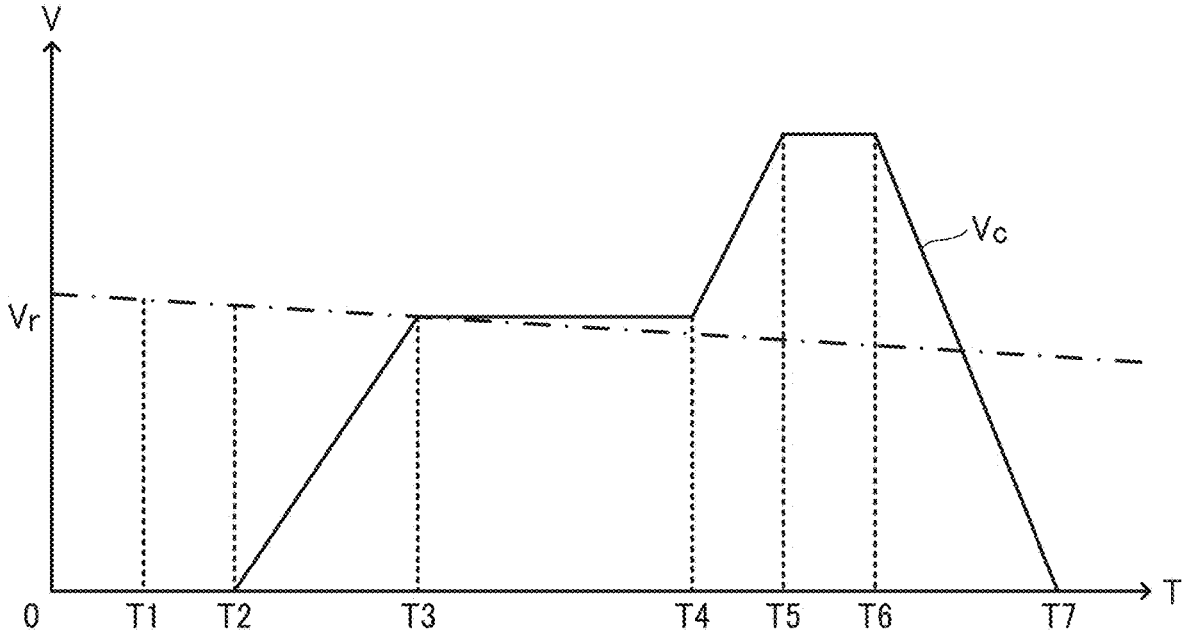
FIG. 6 is a graph of another example of a change in the sheet conveying speed of the sheet conveying unit and the sheet conveying speed of the sheet holder, both provided in the sheet conveying device of FIG. 3.

FIG. 6 is a graph of another example of a change in the sheet conveying speed of the sheet conveying unit 20 and the sheet conveying speed of the sheet holder 30, both provided in the sheet conveying device 100 of FIG. 3.

As illustrated in FIG. 6, the sheet S may be conveyed by the sheet holder 30 according to the difference of the sheet conveying speed of the sheet conveying unit 20 and the sheet conveying speed of the sheet holder 30, generated by a reduction in the sheet conveying speed of the sheet conveying unit 20. Even in this case, the sheet conveying speed of the sheet holder 30 becomes faster than the sheet conveying speed of the sheet conveying unit 20, and therefore the leading end of the sheet S is pulled while the sheet S is being conveyed. Accordingly, sag of the sheet S is more prevented when compared with a case in which the sheet conveying speed of the sheet holder 30 is equal to the sheet conveying speed of the sheet conveying unit 20.

Figure 7:
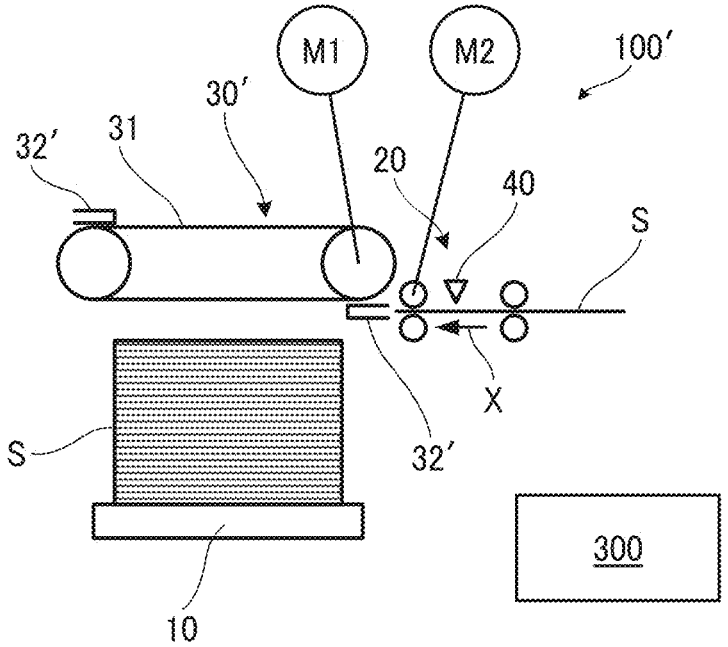
FIG. 7 is a schematic diagram illustrating a configuration of a sheet conveying device according to another embodiment of this disclosure.

Next, a description is given of an example of a configuration of a sheet conveying device 100', with reference to FIG. 7. FIG. 7 is a schematic diagram illustrating a configuration of the sheet conveying device 100' according to another embodiment of this disclosure. It is to be noted that the components identical or similar to the components of the configuration in the embodiments previously described above will be denoted by identical or similar reference numerals, and a description of the components and the configuration will be omitted as appropriate. In the example of the configuration of the sheet conveying device 100' illustrated in FIG. 7, the sheet holder 30 in the above-described embodiment is replaced with a guide 30'. In other words, the sheet conveying device 100' includes the guide 30' while the sheet conveying device 100 includes the sheet holder 30.

The guide 30' includes the sheet conveying belt 31 and a guide member 32'. The sheet conveying belt 31 is rotatably disposed in the guide 30'. The guide member 32' functions as a guide body attached to the sheet conveying belt 31 to receive the leading end of the sheet S. In other words, the leading end of the sheet S enters the guide member 32'. The guide 30' conveys the sheet S that has been conveyed by the sheet conveying unit 20 along the sheet conveying direction X while maintaining a state in which the leading end of the sheet S is inserted, so that the sheet S is guided to the tray 10.

The sheet conveying device 100' according to another embodiment includes the sheet conveying unit 20, the guide member 32', and a controller 300 that functions as circuitry (see FIG. 7). The sheet conveying unit 20 conveys the sheet S. The guide member 32' has a space h that is greater than a thickness of the sheet S. The guide member 32' conveys and guides the sheet S. The leading end of the sheet S that has been conveyed by the sheet conveying unit 20 is caused to be inserted into the space h of the guide member 32'. The controller 300 controls the sheet conveying unit 20 and the guide member 32' such that the sheet S is separated from the space h of the guide member 32' to stack the sheet S onto the tray 10, according to the difference of the sheet conveying speed of the sheet conveying unit 20 and a moving speed of the guide member 32' (i.e., the sheet conveying speed of the sheet conveying belt 31 in the present embodiment). The sheet conveying belt 31 is driven and rotated by a motor M1. The sheet conveying unit 20 is driven and rotated by a motor M2. The controller 300 controls driving operations of the motor M1 and the motor M2, and therefore controls the sheet conveying speed of the sheet conveying unit 20 and the moving speed of the guide member 32' mounted on the sheet conveying belt 31.

Similar to the clips 32 illustrated in FIG. 3, a plurality of guide members 32', including the guide member 32', are arranged along the rotational direction of the sheet conveying belt 31. Similar to the sheet holder 30 illustrated in FIG. 3, the guide 30' includes the plurality of sheet conveying belts 31 disposed in the width direction Y of the sheet S, which intersects the sheet conveying direction X. Further, similar to the plurality of clips 32 in FIG. 3, the plurality of guide members 32' are arranged along the plurality of sheet conveying belts 31, respectively. The plurality of sheet conveying belts 31 is classified to two types, which are end side belts 31*a* and center side belts 31*b*. Each end side belt 31*a* is disposed on an end side in the direction Y, which is the width direction of the plurality of guide members 32'. Each center side belt 31*b* is disposed between the end side belts 31*a* in the direction Y.

The plurality of guide members 32' on the end side belt 31*a* are different in arrangement in the sheet conveying direction X from the plurality of guide members 32' on the center side belt 31*b*. That is, the plurality of guide members 32' mounted on the center side belt 31*b* are disposed upstream from the plurality of guide members 32' mounted on the end side belt 31*a* in a sheet conveying direction of the guide 30' in which the guide 30' conveys the sheet S.

Figure 8:
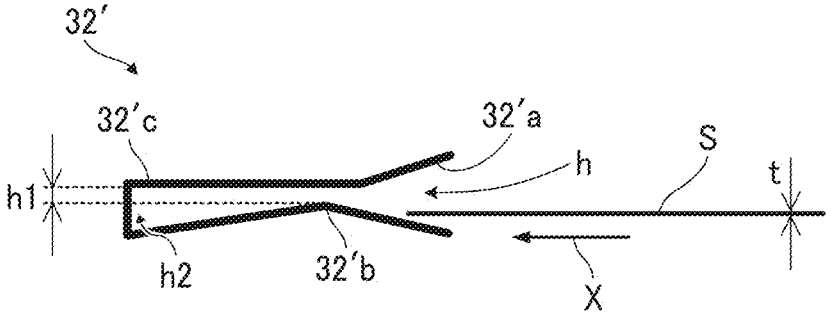
FIG. 8 is a diagram illustrating an example of a guide member provided in the sheet conveying device of FIG. 7.

FIG. 8 is a diagram illustrating an example of the guide member 32' provided in the sheet conveying device 100' of FIG. 7.

As illustrated in FIG. 8, the guide member 32' has an opening 32'*a*, a middle portion 32'*b*, and a far side portion 32'*c*. The leading edge of the sheet S that has entered from the opening 32'*a* according to the difference of the sheet conveying speed of the sheet conveying unit 20 and the sheet conveying speed of the guide 30' passes the middle portion 32'*b* before reaching the far side portion 32'*c*.

The guide member 32' has the space h that is greater than a thickness t of the sheet S to be conveyed by the sheet conveying unit 20. The space h is greater than the thickness t of the sheet S at any position over the entire length in the sheet conveying direction X. Specifically, a minimum gap h1 in the middle portion 32'*b*, which is the narrowest part of the space h in the guide member 32', is greater than the thickness t of the sheet S. In other words, when conveying the sheet S, the guide member 32' according to the present embodiment retains the sheet S without nipping the sheet S while contacting the sheet S. By setting the minimum gap h1 to be greater than the thickness t of the sheet S (h1>t), damage to the sheet S due to the nipping of the sheet S is prevented.

In the present embodiment, the space (gap) in the opening 32'*a* is set to be wider (greater) than the space (gap) in the middle portion 32'*b* and the space (gap) in the far side portion 32'*c*, so that the sheet S easily enters to the far side portion 32'*c*. Further, since a sheet conveying passage from the opening 32'*a* to the middle portion 32'*b* is flat and smooth without any projection or recess, the load applied when the sheet S enters the far side portion 32'*c* is reduced.

In the present embodiment, a gap h2 in the far side portion 32'*c* is wider (greater) than the minimum gap h1 in the middle portion 32'*b*. However, the configuration is not limited to the above-described configuration. For example, the gap h2 in the far side portion 32'*c* may be equal to or narrower (smaller) than the minimum gap h1 in the middle portion 32'*b*. In any case, it is preferable that the minimum gap h1 in the middle portion 32'*b* is greater than the thickness t of the sheet S (h1>t) and that the gap h2 in the far side portion 32'*c* is greater than the thickness t of the sheet S (h2>t). According to this configuration, damage to the sheet S due to nipping of the sheet S is prevented.

It is to be noted that it is preferable to move the guide member 32' so that the leading end of the sheet S does not contact the end face of the far side of the guide member 32' (i.e., a left end face in FIG. 8). Consequently, the leading end of the sheet S is restrained from being bent.

It is preferable that a portion on the surface of the guide member 32' to contact the sheet S is made of a material having high smoothness such as metal and resin. Accordingly, the sheet S is smoothly inserted into the guide member 32' from the opening 32'*a* toward the middle portion 32'*b*.

Figure 9:
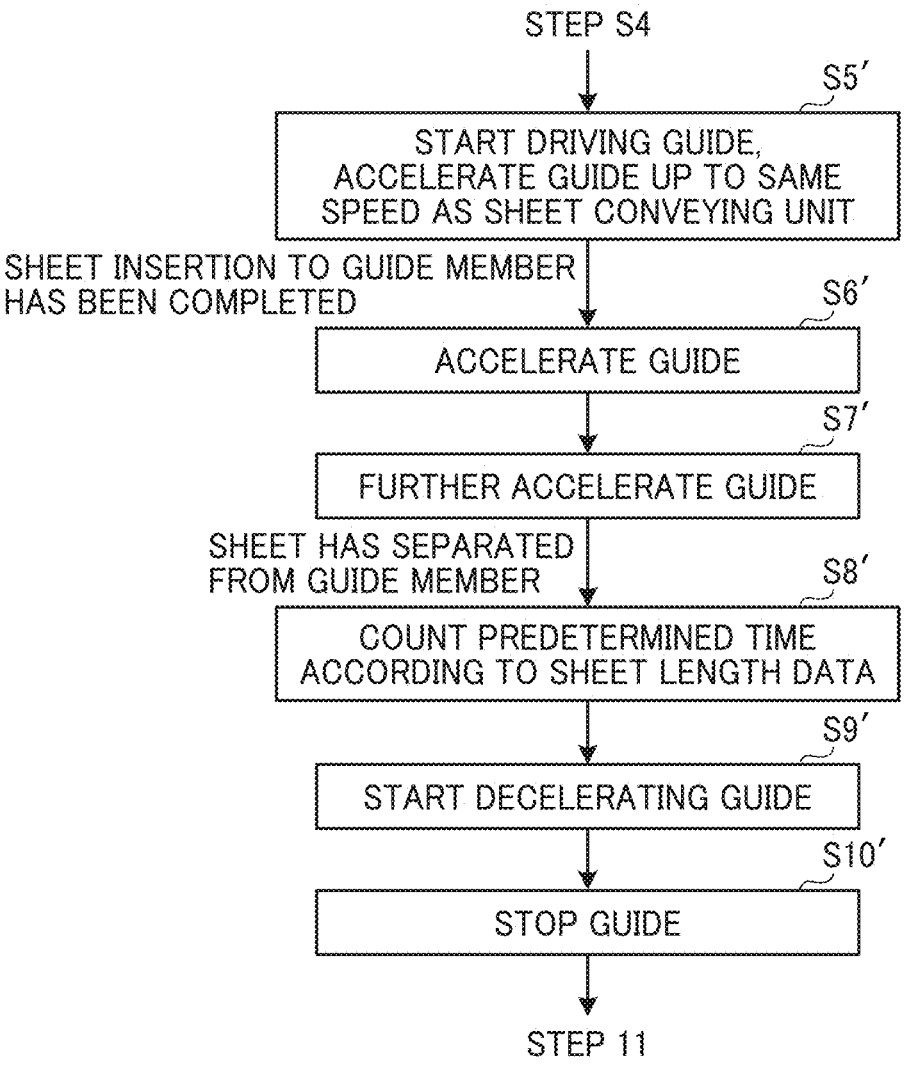
FIG. 9 is a flowchart of an example of a sheet conveying method performed by the sheet conveying device of FIG. 7.

FIG. 9 is a flowchart of an example of a sheet conveying method performed by the sheet conveying device 100' of FIG. 7, describing the driving operations of the guide 30'. Steps S5' to S10' in the flowchart of FIG. 9 correspond to steps S5 to S10 in the flowchart of FIG. 4. Since steps S1 to S4 and steps S11 to S12 in the flowchart of FIG. 9 are same as steps S1 to S4 and steps S11 to S12, respectively, the descriptions of the steps S1 to S4, S11, and S12 are omitted here.

As illustrated in FIG. 9, in step S5', the guide 30' starts driving, so that the guide member 32' that has been stopped at the predetermined position gradually increases the speed. At this time, since the speed of conveyance of the sheet S that has been conveyed by the sheet conveying unit 20 is faster than the moving speed of the guide member 32', the sheet S enters the guide member 32'. The sheet conveying speed of the guide 30' is controlled such that the speed of conveyance of the sheet S is equal to the moving speed of the guide member 32' when the sheet S is completely inserted into the guide member 32', in other words, when the sheet S reaches the far side portion 32'*c* of the guide member 32'.

Thus, the sheet S is inserted into the guide member 32' according to the difference of the moving speed of the guide member 32' and the sheet conveying speed of the sheet conveying unit 20 before these speeds become equal.

When the sheet S is completely inserted into the guide member 32', in step S6', first acceleration of the sheet conveying speed of the guide 30' is performed, and a predetermined time according to the sheet length data that has been previously obtained by the sheet conveying device 100' is counted. The sheet S is conveyed by the sheet conveying unit 20 and the guide 30' according to the difference of the sheet conveying speed of the sheet conveying unit 20 and the sheet conveying speed of the guide 30', generated by the first acceleration. Specifically, the sheet conveying speed of the guide 30' becomes faster than the sheet conveying speed of the sheet conveying unit 20, and therefore sag of the sheet S is prevented when conveying the sheet S.

At this time, the guide member 32' does not nip the sheet S and the sheet conveying speed of the guide 30' is faster than the sheet conveying speed of the sheet conveying unit 20. Therefore, even if the weight of the sheet S and the frictional force between the sheet S and the guide member 32' are taken into consideration, the sheet S gradually comes out from the guide member 32'. However, in the present embodiment, the length in the sheet conveying direction X of the guide member 32' is set sufficiently long. Further, the timing of the operation of the guide member 32' is controlled, and therefore the amount of insertion of the leading end of the sheet S to the guide member 32' is controlled. Consequently, the sufficient amount of insertion of the leading end of the sheet S to the guide member 32' is obtained. Thus, even though the amount of insertion of the sheet S to the guide member 32' gradually decreases due to the above-described speed difference, the length of the guide member 32' and the amount of insertion of the sheet S are set to maintain the state in which the leading end of the sheet S remains in the guide member 32', up to the position from which the sheet S is separated.

When the predetermined time has elapsed since complete insertion of the sheet S into the guide member 32', in step S7', second acceleration of the sheet conveying speed of the guide 30' is performed. Due to the second acceleration, the sheet conveyance speed of the guide 30' becomes further faster than the sheet conveying speed of the sheet conveying unit 20, and the sheet S is separated from the guide member 32'.

Thus, the sheet S that has been inserted into the guide 30' is separated from the guide 30' according to the difference of the sheet conveying speed of the sheet conveying unit 20 and the sheet conveying speed of the guide 30', generated by the second acceleration. After having been separated from the guide 30' and having come out from the sheet conveying unit 20, the sheet S falls onto the tray 10 to be stacked on the tray 10.

In step S8', a predetermined time according to the sheet length data that has been previously obtained is counted.

When the predetermined time has elapsed, the guide 30' starts to gradually decelerate in step S9' and stops in step S10'.

Accordingly, the sheet S is inserted into and separated from the guide member 32' according to the difference of the sheet conveying speed of the sheet conveying unit 20 and the sheet conveying speed of the guide 30'. Consequently, the sheet S is stacked on the tray 10 without providing (installing) an opening and closing mechanism to open and close the guide member 32'.

In the present embodiment, when the sheet S is conveyed by the sheet conveying unit 20 and the guide 30', the sheet conveying speed of the guide 30' is faster than the sheet conveying speed of the sheet conveying unit 20. However, the sheet conveying speed of the guide 30' may be equal to the sheet conveying speed of the sheet conveying unit 20.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

For example, this disclosure may be applied to not only an inkjet image forming apparatus but also an image forming apparatus that forms an image with toner. The image forming apparatus may be a single apparatus such as a copier, a printer, a facsimile machine, a plotter, or may be a multifunctional machine having at least two functions of the copier, printer, facsimile machine, and plotter.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

a tray configured to stack a sheet;

a conveyor including a belt, the conveyor configured to convey the sheet via the belt to the tray in a sheet conveying direction;

a guide including a guide body mounted on a guide conveying belt; and a controller that controls drive motors to drive the guide and the conveyor, wherein the guide body includes a pair of prongs extending in a direction substantially opposite to the sheet conveying direction and separated from each other with a space therebetween having a fixed height that is greater than a thickness of the sheet, the guide configured to guide the sheet as the sheet is being conveyed by the conveyor to the tray by inserting a leading end of the sheet in the space between the pair of prongs such that the guide body is configured to guide the sheet without nipping the sheet between the pair of prongs, the guide body configured to separate the sheet from the space while the sheet is being conveyed by the conveyor to the tray by the controller controlling the drive motors that drive the guide and the conveyor to rotate at speeds that cause a moving speed of the guide body to accelerate relative to a rotational speed of the conveyor, and to stack the sheet on the tray.

2. The sheet conveying device according to claim 1, further comprising a plurality of guide bodies, including the guide body, disposed along a rotational direction of the guide conveying belt.

3. The sheet conveying device according to claim 1, further comprising a plurality of guide conveying belts, including the guide conveying belt, disposed in a width direction of the sheet intersecting the sheet conveying direction of the sheet.

4. The sheet conveying device according to claim 3, further comprising a plurality of guide bodies, including the guide body, respectively disposed on the plurality of guide conveying belts.

5. The sheet conveying device according to claim 4, wherein the plurality of guide conveying belts includes:

end side guide belts, each of which is disposed on an end side in the width direction of the sheet; and a center side guide belt disposed between the end side guide belts in the width direction, and wherein the plurality of guide bodies is disposed at different positions in the sheet conveying direction, between the center side guide belt and each of the end side guide belts.

6. The sheet conveying device according to claim 1, wherein the space of the guide body is greater than the thickness of the sheet at any position over an entire length in the sheet conveying direction of the sheet.

7. The sheet conveying device according to claim 1, further comprising circuitry, wherein the conveyor includes a detector configured to detect the leading end of the sheet, wherein the circuitry is configured to cause the guide body to move after the detector has detected the leading end of the sheet, and cause the conveyor to convey the sheet to enter the space of the guide body until the moving speed of the guide body becomes equal to the rotational speed of the conveyor.

8. The sheet conveying device according to claim 1, wherein the conveyor further includes a roller.

9. An image forming apparatus comprising:

an image forming device configured to form an image on a sheet; and the sheet conveying device according to claim 1, configured to convey the sheet on which the image is formed.

10. The sheet conveying device according to claim 1, wherein the height of the guide body is fixed such that a minimum height of the guide body is greater than the thickness of the sheet as the guide body guides the sheet.

11. The sheet conveying device according to claim 1, wherein the space is greater than the thickness of the sheet at any position over an entirety of a length of the guide body in the sheet conveying direction.

12. The sheet conveying device according to claim 1, wherein the guide body includes a first portion, a second portion and a third portion arranged consecutively in a direction of insertion of the sheet into the guide body with the height of each of the first portion, the second portion and the third portion being greater than the thickness of the sheet as the guide body guides the sheet.

13. The sheet conveying device according to claim 3, wherein the first portion has a first height, the second portion has a second height and the third portion has a third height, the second height being greater than the thickness of the sheet and smaller than each of the first height and the third height.

14. The sheet conveying device according to claim 1, wherein the guide is vertically over the tray.

* * * * *